United States Patent [19]

Gardner

[11] 4,012,855

[45] Mar. 22, 1977

[54] ANTI-SKID FOOTWEAR

[76] Inventor: Denys Gardner, 1529 Acton Blvd., Acton Vale, Canada

[22] Filed: Oct. 28, 1975

[21] Appl. No.: 626,025

[52] U.S. Cl. ..... 36/29; 36/59 R
[51] Int. Cl.[2] ..... A43B 13/20; A43B 23/28
[58] Field of Search ..... 36/29, 32 R, 59 R

[56] References Cited

UNITED STATES PATENTS

| | | | |
|---|---|---|---|
| 2,189,813 | 2/1940 | McGuire | 36/29 |
| 2,580,840 | 1/1952 | Rogndal | 36/29 |
| 3,327,334 | 6/1967 | Wilmanns et al. | 36/32 R |

FOREIGN PATENTS OR APPLICATIONS

| | | | |
|---|---|---|---|
| 138,794 | 2/1920 | United Kingdom | 36/29 |

*Primary Examiner*—Patrick D. Lawson

[57] ABSTRACT

A footwear adapted for anti-skid use, such as on ice or any slippery or hard surfaces, to play a broom ball game or for curling and which includes an outsole of resilient rubber sponge or microcellular rubber or foam material, such as latex or plastic foam, having cavities to allow the outsole to yield in contact with a supporting surface and thereby produce increased traction or antiskidding. This footwear distinctively includes an outsole with cavities opening on the inner face of the outsole and extending in the latter short of the outer face to form a flexible outer wall and yieldable partitions between the cavities with an insole adhered on the inner face of the outsole against these partitions and closing the cavities. These cavities, being sealed by their individual walls and by the insole, produce sealed air spaces which are pushing back the flexible outer wall and protuberances, thus forcing the same to conform to any surface irregularity on which the sole rests.

1 Claim, No Drawings

ANTI-SKID FOOTWEAR

This invention relates to footwear and, more particularly, to a footwear of the anti-skid type.

Footwear of the above type have previously been proposed. In particular, there has been proposed a specific anti-skid footwear, defined in U.S Pat. No. 3,568,340 wherein the anti-skid is produced by cavities opening on the outer face of the outsole, such that the latter will easily yield upon contact with a hard surface. Such externally opening cavities in fact, do produce such increased yield of the outsole, but this reduces the surface area of the outsole which comes in contact with the supporting surface. Since the traction of an outsole is proportional to the surface thereof in contact with the supporting surface, there results a decrease in the traction in proportion to the total area covered by the cavities. In other words, the traction gained by such cavities is in great part lost by the decrease in the surface of the outsole which makes contact with the supporting surface.

It is a general object of the present invention to provide a footwear of the above type, which is particularly adapted for use on essentially sliding surfaces, such as ice, to play a broom ball game or for curling.

It is another general object of the present invention to provide a footwear of the above type with an outsole which yields in contact with a supporting surface without presenting the above-mentioned disadvantages, that is, without reducing the area of the sole making contact with the supporting surface.

The above and other objects and advantages of the present invention will be better understood with the following detailed description of a preferred embodiment thereof, which is illustrated, by way of example, in the accompanying drawings, in which.

Figure 1:
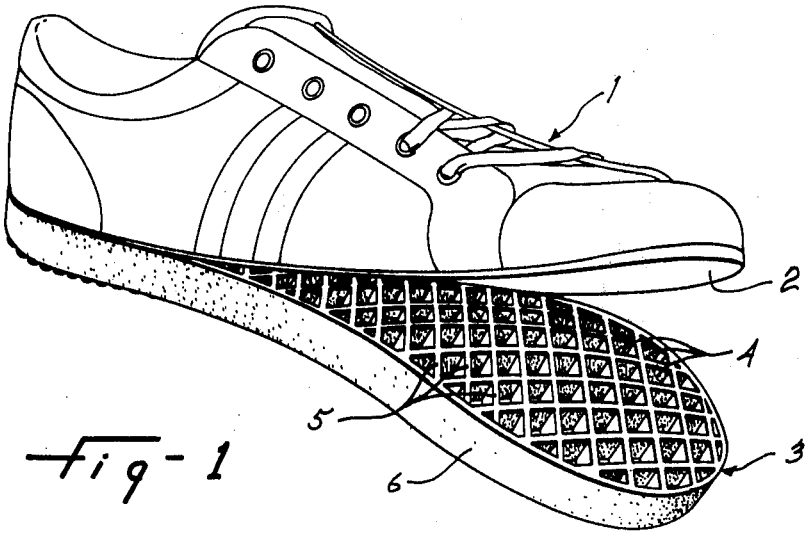
FIG. 1 is a perspective view of a footwear according to a first embodiment of the invention, showing the outsole partially peeled off the remainder of the footwear.
Figure 2:
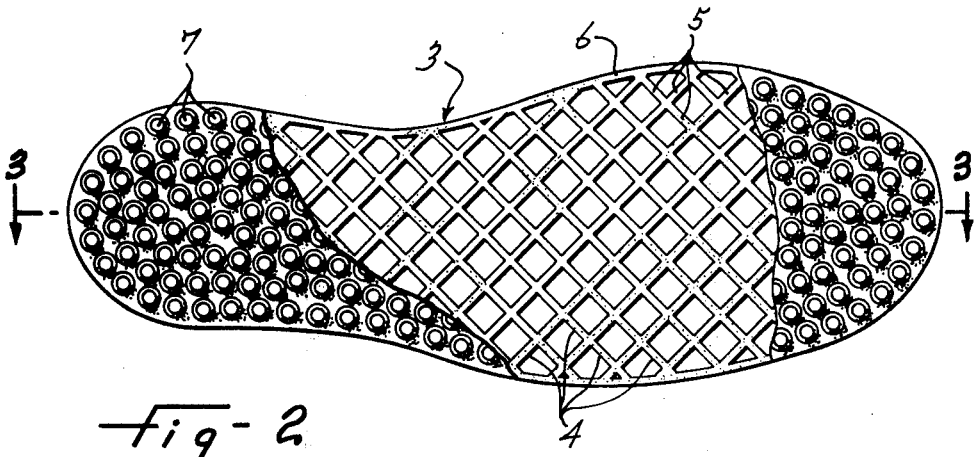
FIG. 2 is a bottom view of the footwear of FIG. 1 with portion of the sole broken away to illustrate the cavities and partitions.
Figure 3:
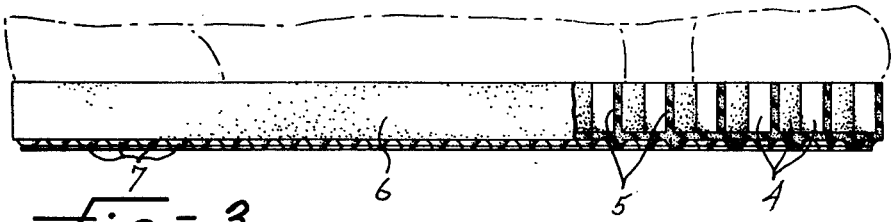
FIG. 3 is a side elevation view of the outsole of FIGS. 1 and 2 and partly seen in cross-section along line 3—3 in FIG. 2.
Figure 4:
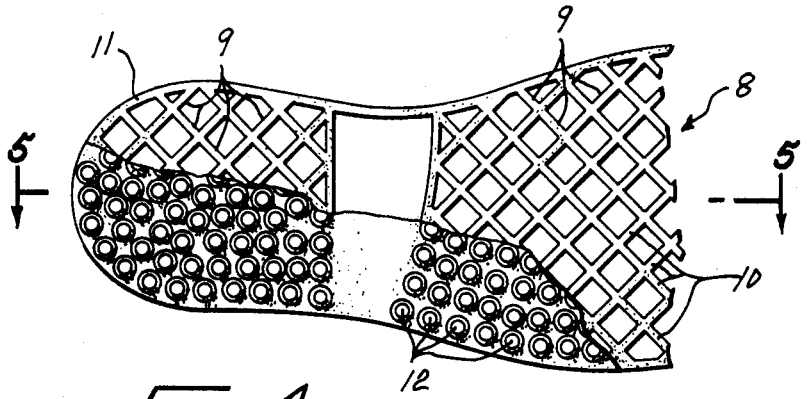
FIG. 4 is a partial bottom view of a footwear according to a second embodiment of the invention and with the outsole partly broken away to illustrate the cavities and the partitions.

The footwear according to the first embodiment of the invention illustrated in FIGS. 1, 2, and 4 constitutes a shoe particularly intended to be worn by the players of broom ball games. This shoe includes an upper 1, of any appropriate and known construction, such as of canvas, rubber, vinyl or a combination of these. An insole 2 is adhered or fixed at the bottom of the upper 1.

An outsole 3 also forms part of this broom ball shoe and is formed with square cavities 4 evenly and symmetricaly distributed across the outsole. The cavities 4 have a square cross-section in the plane of the outsole 3 and are equally spaced apart from each other by partitions 5. The cavities 4, and thus also the partitions 5, extend in the outsole short of the outer face of the latter. Thus, the cavities 4 open on the inner flat face of the outsole and have each one diagonal aligned lengthwise of the outsole. The periphery of the outsole is formed with a continuous side wall 6 of substantially the same thickness as that of partitions 5. The partitions 5 and cavities 4 are evenly distributed throughout the extent of the outersole. The insole 2 is operatively adhered on the inner face of the outsole 3 against the inner edges of partitions 5 and of the side wall 6 and thus closes the cavities 4.

Discrete traction cleats or protuberances 7 are integrally formed on the outer flat face of the outsole 3 for increased traction. These protuberances 7 are evenly distributed on the entire surface of the outer face of the outersole. The outsole is of equal thickness throughout and is formed of resilient and flexible foam material, such as of either closed or open cell rubber sponge, microcellular rubber, latex foam and plastic foam.

It must be noted that the outsole 3 is relatively thick and the cavities extend through most of the thickness of the outsole so that the latter has a thin continuous outer wall defined by the bottom cavities 4 and by the outer face of the outsole 3. The cavities 4 extend to a depth greater than the width thereof. Said outer wall, being thin, resilient and flexible, yields and flexes under the weight of the wearer to conform with irregularities of the supporting surface. Thus, protuberances 7 cling to the supporting surface providing improved anti-skidding.

Figure 5:
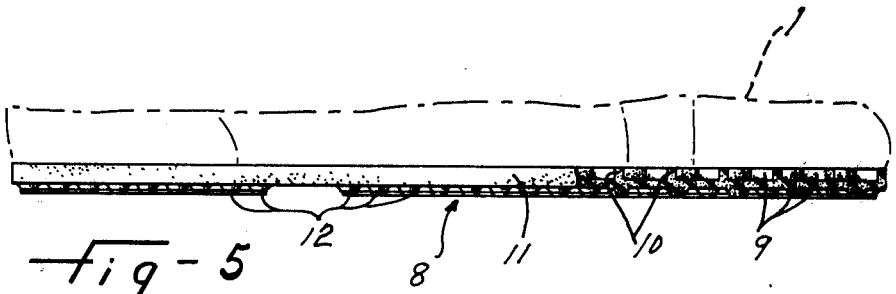
FIG. 5 is a side elevation view of the outsole of FIG. 4 and partly seen in cross-section along line 5—5 in FIG. 4.

The footwear according to the second embodiment of the invention illustrated in FIGS. 4 and 5 constitutes a shoe particularly intended to be worn by curlers. This shoe also includes an upper 1 and an insole, not shown, as aforedescribed.

This shoe of FIGS. 4 and 5 also includes an outsole 8 formed with square cavities 9, partitions 10, an outer wall 11 and protuberances 12 arranged relative to each other as aforedescribed for the corresponding elements 4, 5, 6, and 7.

However, in this second embodiment, the outsole 8 is relatively thin and the cavities 9 extend through about half the thickness of this outsole. In other words, the cavities 9 extend to a depth not exceeding the width thereof.

The outsole 8 is also formed of either open or closed cell resilient foam material.

I claim:

1. An anti-skid footwear comprising an outsole of resilient and flexible rubber sponge material and of substantially uniform thickness throughout so that it will yield under the weight of a wearer, said outsole defining a flat outer face and a flat inner face and having cavities opening at the inner face and extending in the outsole short of the outer face, the bottom of said cavities and said outer face defining a thin outer wall, and partitions of substantially uniform thickness separating said cavities from one another in laterally spaced-apart relationship across the outsole, said cavities and partitions evenly distributed across the entire extent of said outsole, the periphery of said outsole having a continuous side wall of a thickness substantially equal to the thickness of said partitions, an insole adhered to the inner face of the outsole and closing said cavities, and evenly distributed discrete protuberances integrally formed on the outer face of the outsole for tractive engagement of the outsole on a supporting surface, said outer wall yielding and flexing to conform to irregularities of said supporting surface under the weight of a wearer of said footwear.

* * * * *